US009015867B2

(12) United States Patent
Kenney et al.

(10) Patent No.: US 9,015,867 B2
(45) Date of Patent: Apr. 28, 2015

(54) CONVERTIBLE GOLF GARMENT WITH INTEGRATED BELT LOOPS

(75) Inventors: Kimberly A. Kenney, Portland, OR (US); Eileen M. Vlasak, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 347 days.

(21) Appl. No.: 12/907,727

(22) Filed: Oct. 19, 2010

(65) Prior Publication Data

US 2012/0090076 A1 Apr. 19, 2012

(51) Int. Cl.

| | |
|---|---|
| ***A41F 9/00*** | (2006.01) |
| ***A41D 15/02*** | (2006.01) |
| ***A41D 13/00*** | (2006.01) |
| *A41D 27/20* | (2006.01) |

(52) U.S. Cl.

CPC ..... *A41D 15/02* (2013.01); *A41D 27/20* (2013.01); *A41D 2600/10* (2013.01); *A41F 9/007* (2013.01); *A41D 13/0017* (2013.01)

(58) Field of Classification Search

CPC ..... A41F 9/007
USPC ..... 2/212, 211, 213, 216, 217, 220, 227, 2/228, 229, 240, 301, 331, 336, 338, 271, 2/DIG. 2, 121, 46, 115, 117, 120, 122, 2/75, 80, 111, 234, 235, 236, 237, 76, 2/218, 219, 221

See application file for complete search history.

(56) References Cited

U.S. PATENT DOCUMENTS

| | | | | |
|---|---|---|---|---|
| 1,107,303 | A * | 8/1914 | Henderson | 2/70 |
| 1,504,249 | A | 8/1924 | Klein | |
| 2,022,621 | A * | 11/1935 | Ide | 2/67 |
| 2,289,429 | A | 7/1942 | Jackson | |
| 2,685,092 | A | 8/1954 | Singer | |
| 2,912,698 | A | 11/1959 | Greenblatt | |
| 3,574,237 | A | 4/1971 | Reynolds | |
| 5,566,393 | A | 10/1996 | Best | |
| 6,148,443 | A * | 11/2000 | Maastricht | 2/69 |
| 6,389,600 | B1 * | 5/2002 | Di Maio | 2/121 |
| 2004/0163159 | A1 | 8/2004 | Edwards et al. | |

(Continued)

FOREIGN PATENT DOCUMENTS

| | | | |
|---|---|---|---|
| GB | 503628 | A | 4/1939 |
| KR | 2009-0009184 | U | 9/2009 |

OTHER PUBLICATIONS

The International Search Report and Written Opinion of PCT/US11/56879; dated Mar. 15, 2012.

(Continued)

*Primary Examiner* — Danny Worrell
*Assistant Examiner* — Khaled Annis
(74) *Attorney, Agent, or Firm* — Shook, Hardy & Bacon L.L.P.

(57) ABSTRACT

A multi-layered garment may comprise components that are affixed using integrated belt loops. In particular, shorts belt loops of a shorts component may pass through an opening created when single-layer skirt belt loops of a skirt component are oriented outwards. Both the skirt belt loops and the shorts belt loops may be fully functional and aesthetically pleasing belt loops. Additionally, the shorts belt loops may be combined with the skirt belt loops to form integrated belt loops, thereby allowing a belt to pass beneath both sets of belt loops simultaneously to affix the shorts component to the skirt component.

4 Claims, 10 Drawing Sheets

(56) References Cited

U.S. PATENT DOCUMENTS

| | | | |
|---|---|---|---|
| 2007/0245461 | A1 | 10/2007 | Sprague |
| 2008/0047045 | A1 | 2/2008 | Atallah |

OTHER PUBLICATIONS

European Search Report dated Mar. 18, 2014 in European Application No. 11835065.1,10 pages.

* cited by examiner

CONVERTIBLE GOLF GARMENT WITH INTEGRATED BELT LOOPS

CROSS-REFERENCE TO RELATED APPLICATIONS

Not Applicable.

FIELD

The present invention relates to a multi-layered athletic garment, such as a garment covering a lower portion of an athlete. More particularly, the multi-layered athletic garment has multiple layers secured together and to the wearer through the use of integrated belt loops.

SUMMARY

Many women have a preference for the aesthetic appearance of skirts. Due to considerations of modesty, women may strongly prefer to wear shorts or pants beneath a skirt for some sports. In the game of golf, for example, women who wear skirts generally wear shorts as well. For instance, a woman may wear a pair of shorts under a skirt. However, the use of two separate garments may result in excess bulk and disorientation between the garments, causing discomfort to the wearer, a loss of flexibility for the wearer, and/or decreased athletics. Alternatively, some women wear shorts that are permanently affixed to skirts. However, the permanent nature of the affixation requires the wearer to throw out the entire garment when only one portion is damaged. For instance, if the wearer gets a hole in the skirt, the entire garment is damaged, even if the shorts are otherwise undamaged.

As such, there remains a need for a multi-layered athletic garment having components that are separably affixed. Accordingly, methods are provided to separably affix components of a multi-layered athletic garment through the use of integrated belt loops that combine belt loops from multiple layers of the garment into fully functional and aesthetically pleasing integrated belt loops. To address this need, disclosure is provided of a multi-layered garment having a shorts component and a skirt component. The shorts and skirt components are able to be secured through the use of integrated belt loops. Further, the skirt component may be affixed to the shorts component independent of the orientation of the skirt. In particular, the skirt component may be reversible such that either side of the skirt component may be affixed to the shorts component in accordance with the discussion herein.

The skirt component of the athletic garment in accordance with the present invention may be composed of one type of fabric, or even a single piece of fabric. In particular, the skirt component may be formed from one piece of fabric with belt loops created by cutting two slits into a portion of the material on either side of each resultant belt loop. In this way, the single-layer belt loops of the skirt are reversible, in that they can be raised from the material on either side of the skirt component to hold a belt. Further, the shorts component of the athletic garment may be any form of shorts, pants, or undergarment having belt loops ("shorts belt loops") that align with the belt loops of the skirt component ("skirt belt loops"). Accordingly, when the skirt belt loops are raised in anticipation of holding a belt, the shorts belt loops may be pushed through the holes in the skirt component resulting from the outwardly protruding skirt belt loops such that the shorts belt loops are pressed against the skirt belt loops. Each combination of a shorts belt loop pressed against a skirt belt loop may be referred to as an integrated belt loop. Each shorts belt loop and each skirt belt loop may function independently as an aesthetically pleasing belt loop, but the combination of a skirt belt loop and a shorts belt loop may also function as an aesthetically pleasing belt loop, as described herein. As such, a belt may pass through the integrated belt loops composed of the skirt belt loops and the shorts belt loops.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
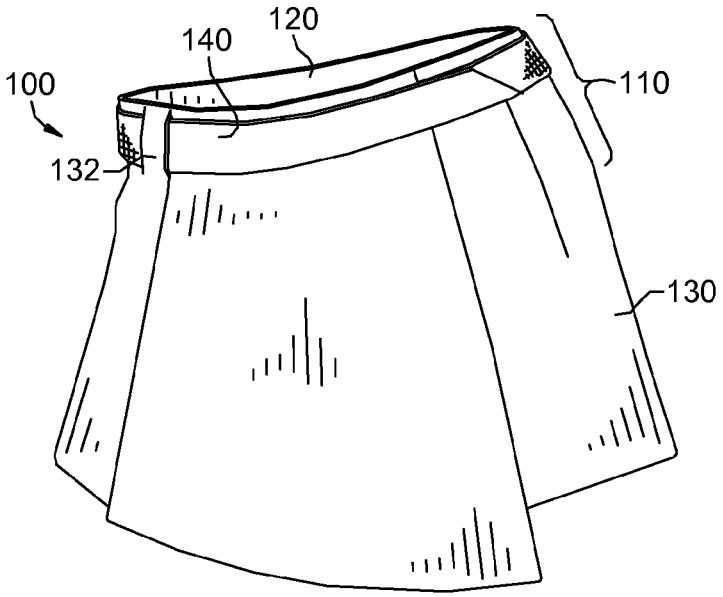
FIG. 1 illustrates a perspective view of an example multi-layered athletic garment in accordance with the present invention.

Referring to FIG. 1, a perspective view 100 of an example athletic garment 110 is shown. In particular, athletic garment 110 may be worn by a wearer, such as an athlete, during an athletic activity. Athletic garment 110 is a multi-layered garment having shorts component 120, skirt component 130, and belt 140. Shorts component 120 has shorts belt loops (not shown in this figure). Additionally, skirt component 130 has skirt belt loops 132 which are integrated with the shorts belt loops.

The alignment of the shorts belt loops of shorts component 120 with skirt belt loops 132 of skirt component 130 allows both sets of belt loops to be integrated or combined to create a functioning and aesthetically pleasing belt loop. In particular, each shorts belt loop may pass through an opening in skirt component 130 to be integrated with a corresponding skirt belt loop 132. Belt 140 may then be used to secure shorts component 120 to skirt component 130 by passing through the integrated belt loops. As seen in FIG. 1, belt 140 passes through the integrated belt loops of athletic garment 110, securing shorts component 120 to skirt component 130. Once belt 140 has passed through the integrated belt loops, belt 140 may then be secured using belt buttons (not shown in this figure). In particular, belt buttons may take the form of snap-on buttons. Alternatively, belt 140 may be secured using another form of button closure, the use of a belt buckle, or another method of securing a belt.

Figure 2:
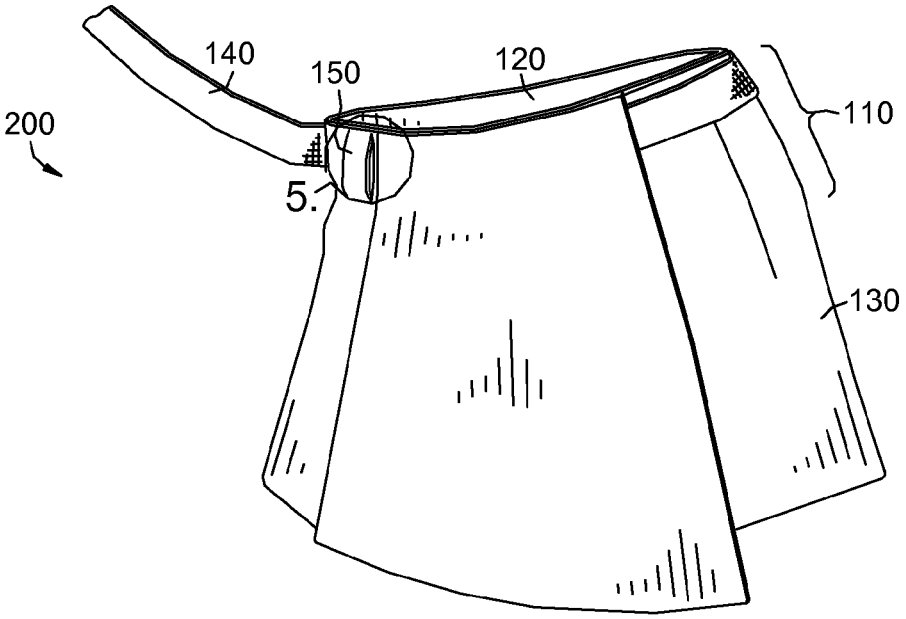
FIG. 2 illustrates a perspective view of the example multi-layered athletic garment of FIG. 1 with a partially open belt in accordance with the present invention.

FIG. 2 illustrates a perspective view 200 of the example multi-layered athletic garment 110 of FIG. 1 with a partially open belt 140 in accordance with the present invention. As seen in FIG. 2, the integrated belt loop 150 of athletic garment 110 is formed into a singular belt loop through which belt 140 may pass. As discussed above, integrated belt loop 150 is formed by combining a shorts belt loop 122 and a skirt belt loop 132. Further, in FIG. 2, skirt component 130 is a wrap skirt. Alternatively, skirt component 130 may be a reversible continuous skirt, such as a stretch skirt, a skirt with a reversible zipper, or a combination of both.

Figure 3:
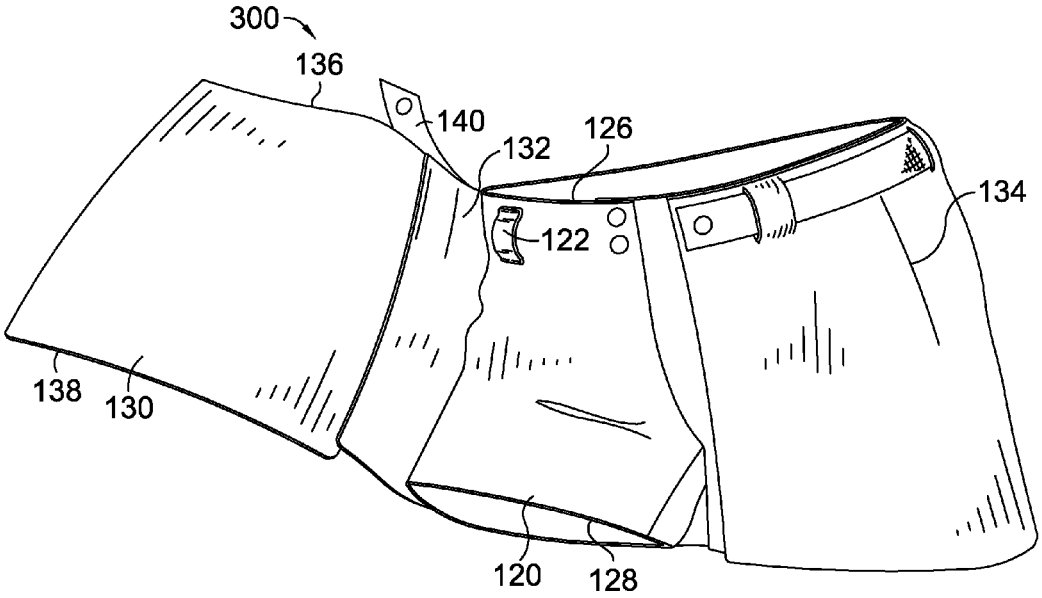
FIG. 3 illustrates a perspective view of the example multi-layered athletic garment of FIG. 1 with a partially open skirt component in accordance with the present invention.

FIG. 3 illustrates a perspective view 300 of the example multi-layered athletic garment 110 of FIG. 1 with a partially open skirt component 130 in accordance with the present invention. In particular, FIG. 3 illustrates the way in which skirt component 130, having a top skirt waistband edge 136 and an opposing skirt bottom edge 138, covers shorts component 120, having a top shorts waistband edge 126 and an opposing shorts bottom edge 128. As seen in FIG. 3, skirt component 130 is a wrap skirt that wraps around shorts component 120. Accordingly, shorts belt loops 122 are aligned with skirt belt loops 132. The width of skirt belt loops 132 is slightly larger than the width of shorts belt loops 122, allowing shorts belt loops 122 to pass through the openings created when skirt belt loops 132 are oriented outwards (i.e., away from shorts component 120). Additionally, the height of skirt belt loops 132 is slightly taller than the height of shorts belt loops 122 in order for shorts belt loops 122 to pass easily through the openings created as discussed above. In particular, each of shorts belt loops 122 may pass far enough through the openings created when each of skirt belt loops 132 are oriented outwards such that belt 140 may be passed through belt loops 122 and 132 at the same time.

Additionally, FIG. 3 includes skirt pocket 134 of skirt component 130 and a shorts pocket (not shown in this figure) of shorts component 120. The shorts and skirt pockets may be connected. In particular, the shorts and skirt pockets may be connected through the use of a pass-through pocket. For example, a zipper may be included in skirt pocket 134 in order to allow access to the shorts pocket. Further, the zipper may be reversible. Alternatively, skirt pocket 134 may be directly connected into the shorts pocket such that at least a portion of the volume of skirt pocket 134 is held within the shorts pocket. As such, skirt pocket 134 may be smaller than the shorts pocket.

Figure 4:
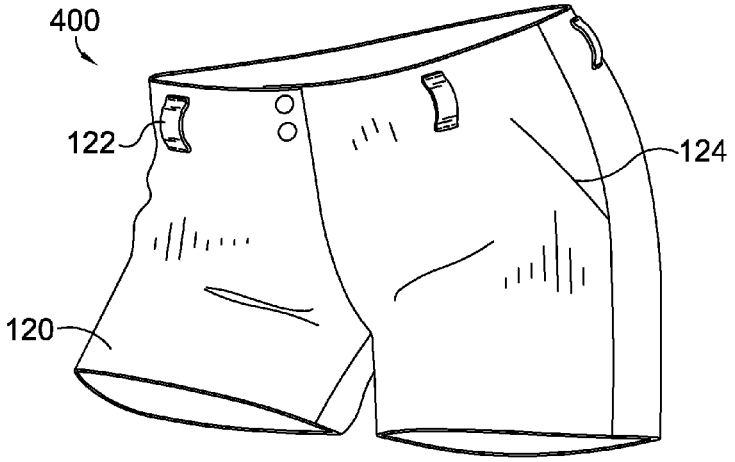
FIG. 4 illustrates a perspective view of a shorts component of the multi-layered athletic garment of FIG. 1 in accordance with the present invention.

An illustrative shorts component 120 is provided in FIG. 4. In particular, FIG. 4 illustrates a perspective view 400 of a shorts component 120 of the multi-layered athletic garment 110 of FIG. 1 in accordance with the present invention. Shorts component 120 includes shorts belt loops 122 and shorts pocket 124. Shorts pocket 124 may be integrated with a pocket of a skirt component, such as skirt pocket 134 discussed above. Additionally, shorts component 120 may be interchangeable with other undergarments, such as shorts, that have shorts belt loops 122 aligned in accordance with the belt loops of a skirt component, such as skirt belt loops 132. Accordingly, integrated belt loops may be used to form a multi-layered athletic garment with interchangeable components.

Figure 5:
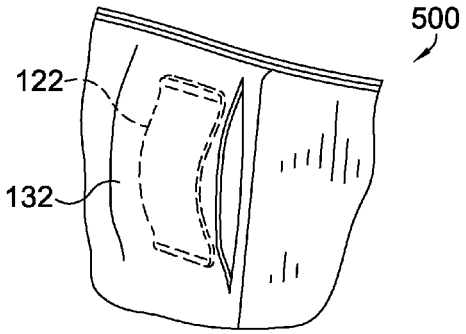
FIG. 5 illustrates a section view of integrated belt loops of the multi-layered athletic garment of FIG. 1 in accordance with the present invention.
Figure 6:
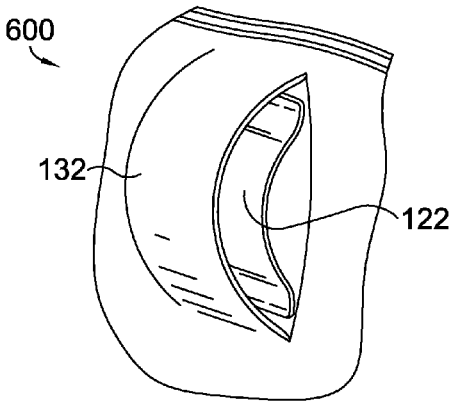
FIG. 6 illustrates another section view of integrated belt loops of the multi-layered athletic garment of FIG. 1 in accordance with the present invention.
Figure 7:
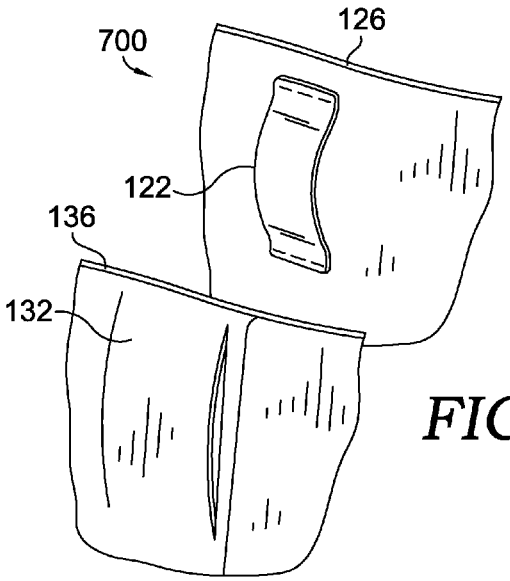
FIG. 7 illustrates an exploded view of integrated belt loops of the multi-layered athletic garment of FIG. 1 in accordance with the present invention.

An example of integrated belt loops is illustrated in FIG. 5. In particular, FIG. 5 is a section view 500 of integrated belt loops of multi-layered athletic garment 110 of FIG. 1 in accordance with the present invention. In particular, shorts belt loop 122 passes through an opening created when skirt belt loop 132 is oriented outwards. Additionally, shorts belt loop 122 is pressed against skirt belt loop 132 to form an integrated belt loop. To illustrate this more clearly, FIG. 6 illustrates another section view 600 of integrated belt loops of multi-layered athletic garment 110 of FIG. 1. In FIG. 6, shorts belt loop 122 is partially through the opening created when skirt belt loop 132 is oriented outwards. Further, FIG. 7 illustrates an exploded view 700 of integrated belt loops of multi-layered athletic garment 110 in accordance with the present invention. As seen in FIG. 7, shorts belt loop 122 is slightly narrower than skirt belt loop 132 to allow belt loop 122 to easily pass through an opening created when skirt belt loop 132 is oriented outwardly. In embodiments, shorts belt loop 122 may be cupped to hold skirt belt loop 132. Alternatively, skirt belt loop 132 may be cupped to hold shorts belts loop 122. FIG. 7 further illustrates the position of the top skirt waistband edge 136 relative to the skirt belt loop 132, and the position of the top shorts waistband edge 126 relative to the shorts belt loop 122.

Figure 8:
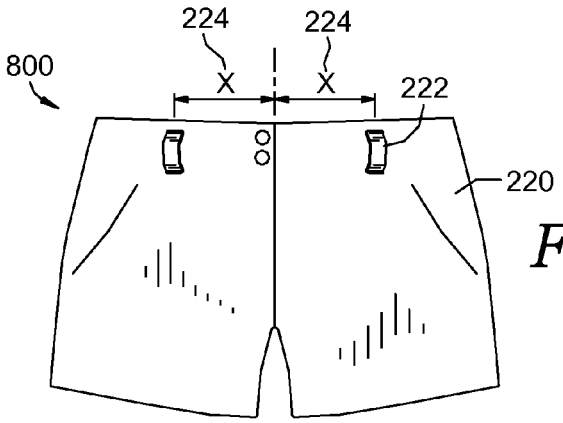
FIG. 8 illustrates a front view of a shorts component of a second example of a multi-layered athletic garment in accordance with the present invention.

In order for belt loops of a shorts component to be integrated with belt loops of a skirt component, the belt loops of each component must be aligned. Accordingly, FIG. 8 illustrates a front view 800 of a shorts component of a second example of a multi-layered athletic garment in accordance with the present invention. As seen in FIG. 8, a portion of shorts belt loops 222 are positioned at a distance 224, designated as "x," from the center line of shorts component 220. Additionally, a further portion of shorts belt loops 222 are positioned at a further distance (not shown) designated as "y," from the center line of shorts component 220. Further, FIG. 9 illustrates an expanded view 900 of a skirt component of the multi-layered athletic garment of FIG. 8 in accordance with the present invention.

Figure 9:
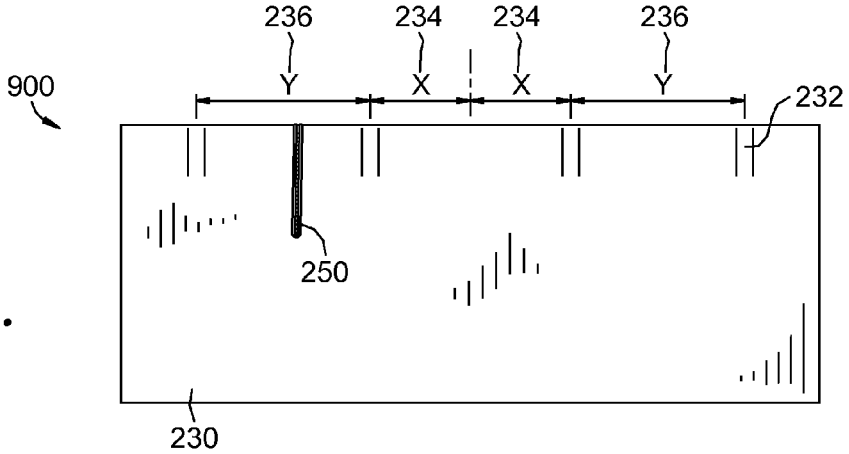
FIG. 9 illustrates an expanded view of a skirt component of the multi-layered athletic garment of FIG. 8 in accordance with the present invention.

As seen in FIG. 9, a portion of skirt belt loops 232 are positioned at a distance 234, designated as "x," from the center line of skirt component 230. Accordingly, the portion of shorts belt loops 222 positioned at distance "x" from the center line of shorts component 220 are aligned with the portion of skirt belt loops 232 positioned at distance "x" from the center line of skirt component 230. Additionally, a further portion of skirt belt loops 232 are positioned at a further distance 236, designated as "y," from the center line of skirt component 230. As such, shorts belt loops 222 and skirt belt loops 232 are symmetrically aligned from center line 250 of athletic garment 210. Further, as skirt belt loops 232 are aligned equidistant along the length of skirt component 230, skirt belt loops 232 are aligned with shorts belt loops 222 independent of whether skirt component 230 is in a first position (shown) or a second, reversed position (not shown in this figure). As such, when shorts component 220 is aligned with skirt component 230, as seen in FIG. 10, the belt loops 222 and 232 of each component may be combined to form an integrated belt loop.

Figure 10:
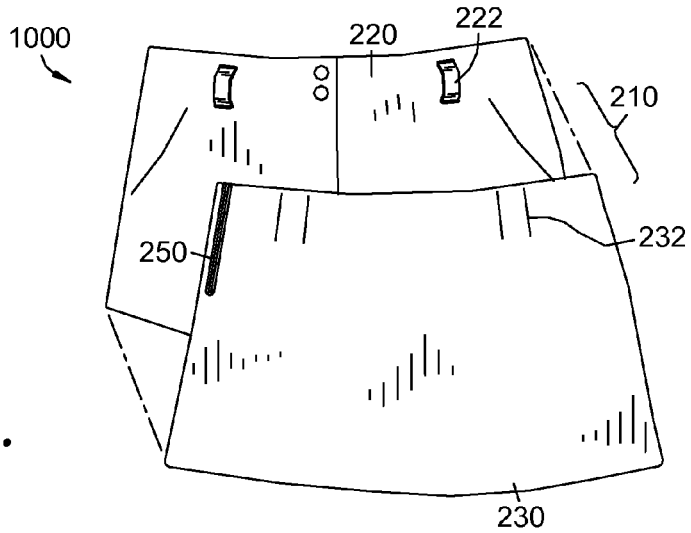
FIG. 10 illustrates an exploded view of the multi-layered athletic garment of FIG. 8 in accordance with the present invention.

An illustration of shorts component 220 affixed to skirt component 230 is shown in FIG. 10. In particular, FIG. 10 illustrates an exploded view 1000 of multi-layered athletic garment 210 of FIG. 8 in accordance with the present invention. Once shorts component 220 and skirt component 230 are aligned, the belt loops 222 and 232 of each component may be integrated by passing shorts belt loops 222 through openings created when skirt belt loops 232 are oriented outwards. In particular, by coupling shorts belt loops 222 to skirt belt loops 232, a belt may be passed beneath both sets of belt loops simultaneously to affix shorts component 220 to skirt component 230.

Figure 11:
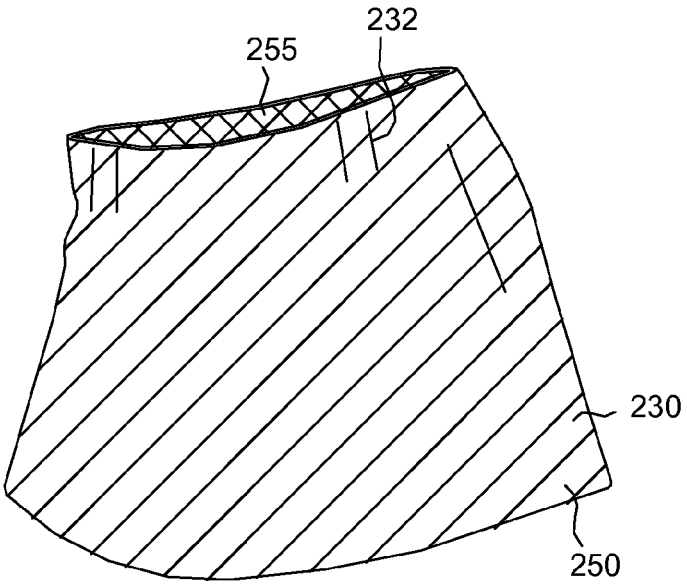
FIG. 11 illustrates a perspective view of a first side of a skirt component of the multi-layered athletic garment of FIG. 8 in accordance with the present invention.
Figure 12:
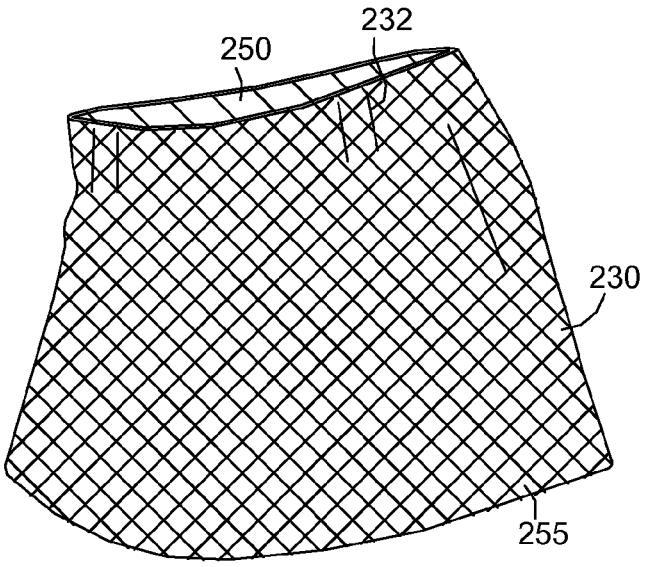
FIG. 12 illustrates a perspective view of a second side of the skirt component of the multi-layered athletic garment of FIG. 8 in accordance with the present invention.

Additionally, a skirt component may be separable from a multi-layered athletic garment. In particular, the skirt component may be separated from the athletic garment and may be worn alone. For instance, belt loops within the skirt component may be oriented outwards to allow a belt to pass through to hold up the skirt component. Further, as discussed above, a skirt component in accordance with the present invention may be reversible. As such, FIG. 11 illustrates a perspective view 1100 of a first orientation of a skirt component of multi-layered athletic garment 210 of FIG. 8, in accordance with the present invention. As seen in FIG. 11, a first portion of skirt component 230 facing outwards is pattern 250 and a second portion of skirt component 230 facing inwards is pattern 255. Further, skirt component 230 may be oriented such that pattern 255 of skirt component is facing outwards and pattern 250 of skirt component 230 is facing inwards. Accordingly, FIG. 12 illustrates a perspective view 1200 of a second orientation of the skirt component of the multi-layered athletic garment of FIG. 8 in accordance with the present invention.

Figure 13:
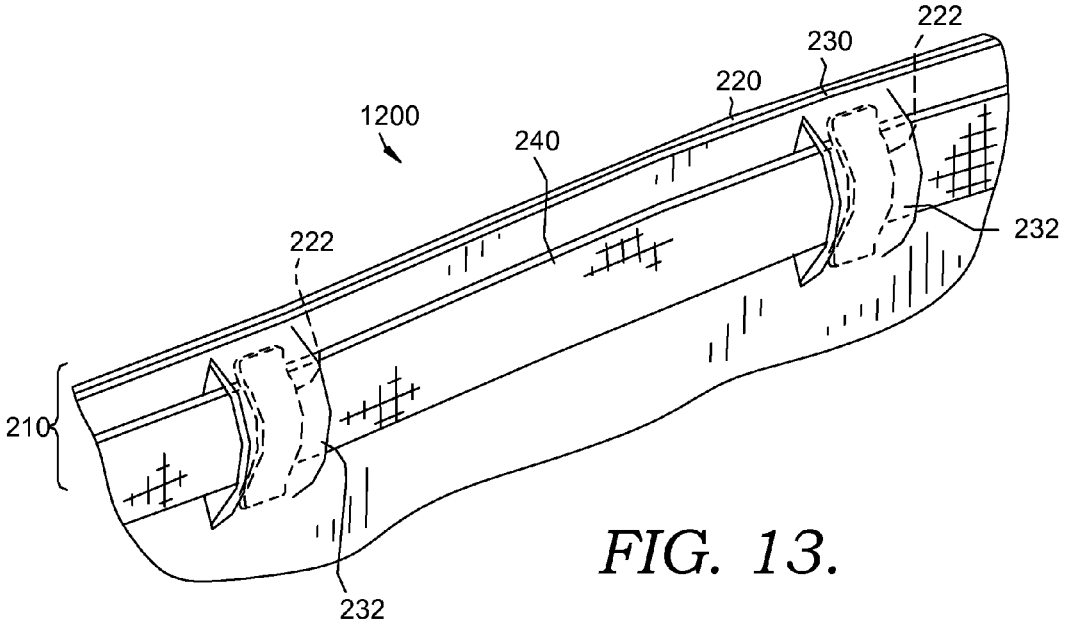
FIG. 13 illustrates a section view of belted integrated belt loops of the multi-layered athletic garment of FIG. 8 in accordance with the present invention.

Further, FIG. 13 illustrates a section view 1300 of belted integrated belt loops of multi-layered athletic garment 210 of FIG. 8 in accordance with the present invention. In particular, FIG. 13 comprises belt 240 passing through the inner portion of integrated belt loops. The integrated belt loops are composed of shorts belt loops 222 and skirt belt loops 232. Accordingly, belt 140 is used to affix shorts component 220 to skirt component 230. Additionally, the integrated belt loops may be symmetrically aligned with respect to a center line of athletic garment 210. As such, skirt component 230 may be reversible. Alternatively, the integrated belt loops may be asymmetrically aligned with respect to the center line of athletic garment 210. Independent of the symmetry of how the integrated belt loops are aligned, however, the integrated belt loops may be used to affix multiple layers of athletic garment 210 in accordance with the present invention.

Figure 14:
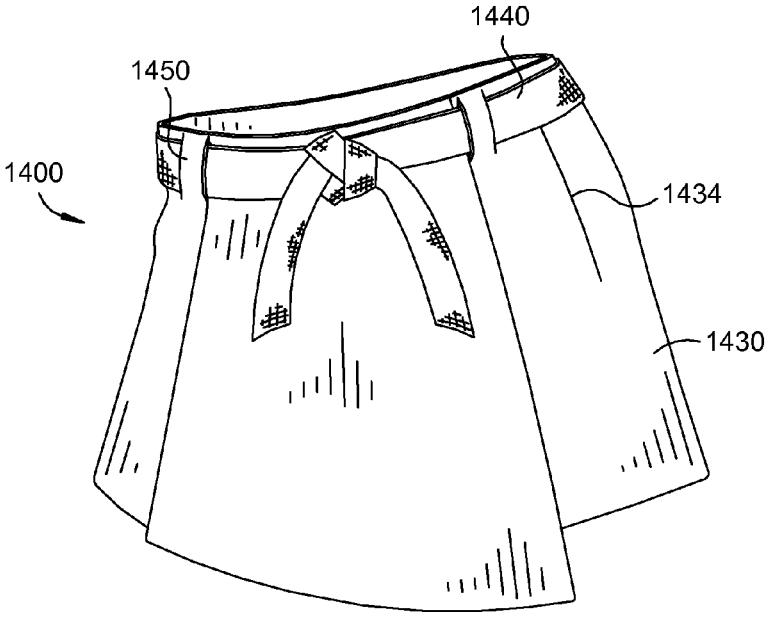
FIG. 14 illustrates a front view of an example multi-layered athletic garment in accordance with the present invention.

FIG. 14 illustrates a front view 1400 of an example multi-layered athletic garment 1410 in accordance with the present invention. Athletic garment 1410 is a tied multi-layered garment having shorts component (not shown), skirt component 1430, pocket 1434, belt 1440, and integrated belt loops 1450. As seen in FIG. 14, the shorts component (not shown) is integrated with skirt component 1430 by having shorts belt loops (not shown) of the shorts component integrated with skirt belt loops (not shown) of skirt component 1430 and secured with belt 1440.

Figure 15:
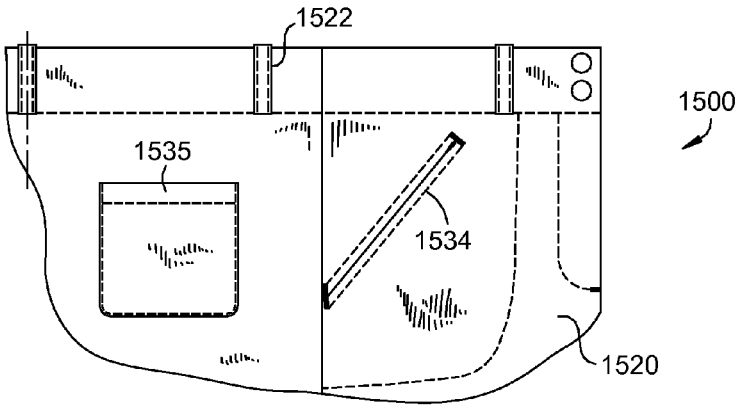
FIG. 15 illustrates a section view of a pocket of an example multi-layered athletic garment in accordance with the present invention.
Figure 16:
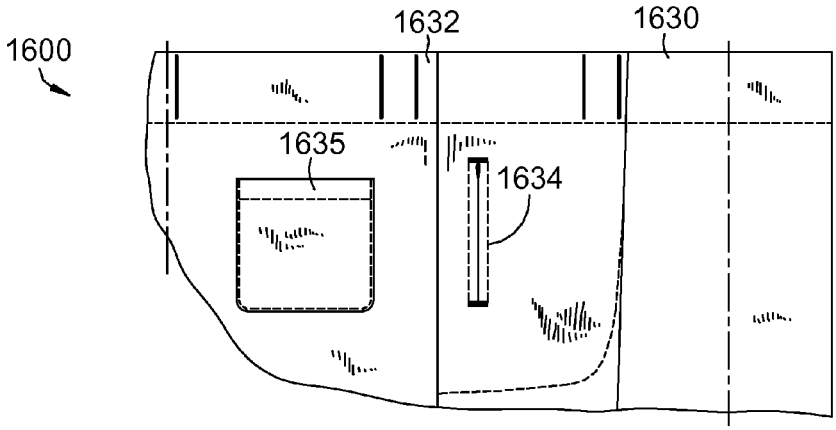
FIG. 16 illustrates a section view of a pocket of an example multi-layered athletic garment in accordance with the present invention.

FIG. 15 illustrates a section view 1500 of a pocket 1534 of an example multi-layered athletic garment in accordance with the present invention. As seen in FIG. 15, shorts component 1520 has diagonally slanted pocket 1534 and back pocket 1535. Additionally, view 1500 illustrates shorts belt loops 1522. Similarly, FIG. 16 illustrates a section view 1600 of pocket 1634 of an example multi-layered athletic garment in accordance with the present invention. In particular, view 1600 is of skirt component 1630. Accordingly, view 1600 includes vertical pocket 1634 and back pocket 1635. Further, skirt belt loops 1632 of skirt component 1630 are shown in view 1600.

Figure 17:
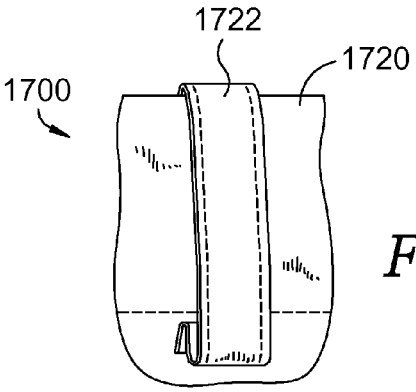
FIG. 17 illustrates a section view of belt loops of an example multi-layered athletic garment in accordance with the present invention.

FIG. 17 illustrates a section view 1700 of shorts belt loops 1720 of an example multi-layered athletic garment in accordance with the present invention. In particular, shorts component 1720 has shorts belt loops 1722 that are secured on the front and back portion of shorts component 1720. This is in contrast to shorts belt loops 122 shown in FIG. 4 where the shorts belt loops 122 are only secured on the front of shorts component 120.

Figure 18:
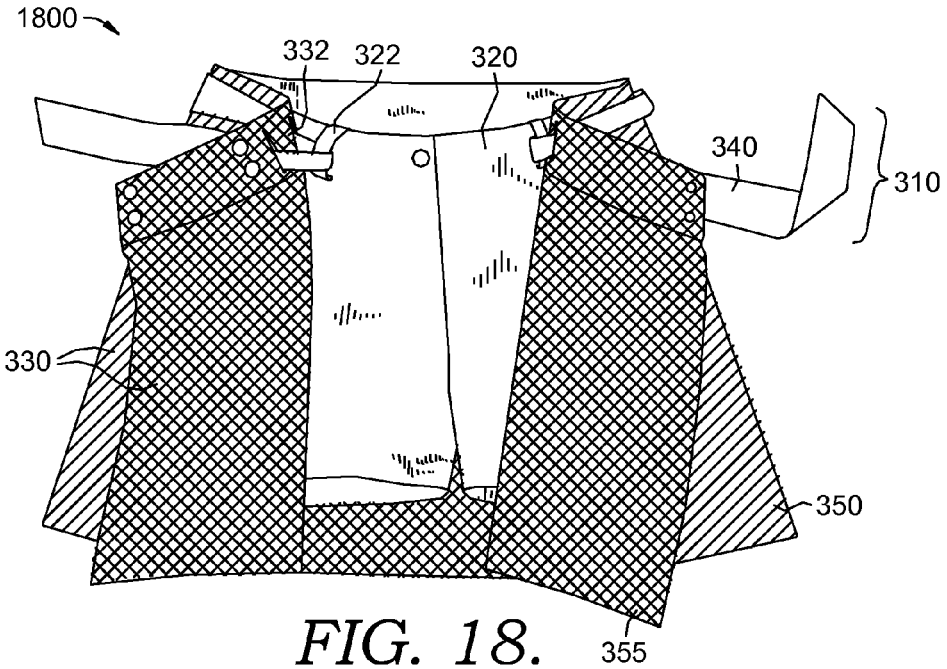
FIG. 18 illustrates a perspective view of a first side of a skirt component of a multi-layered athletic garment in an open position in accordance with the present invention.

FIG. 18 illustrates a perspective view 1800 of a first side of a skirt component of a multi-layered athletic garment in an open position in accordance with the present invention. In particular, FIG. 18 illustrates a first side 350 of a skirt component 330 covering a shorts component 320 of a multi-layered athletic garment 310. Further, skirt component 330 is opened to reveal a second side 355 of skirt component 330. As with previous embodiments, skirt component 330 is secured to shorts component 320 by passing a belt 340 through shorts belt loops 322 and skirt belt loops 332.

Figure 19:
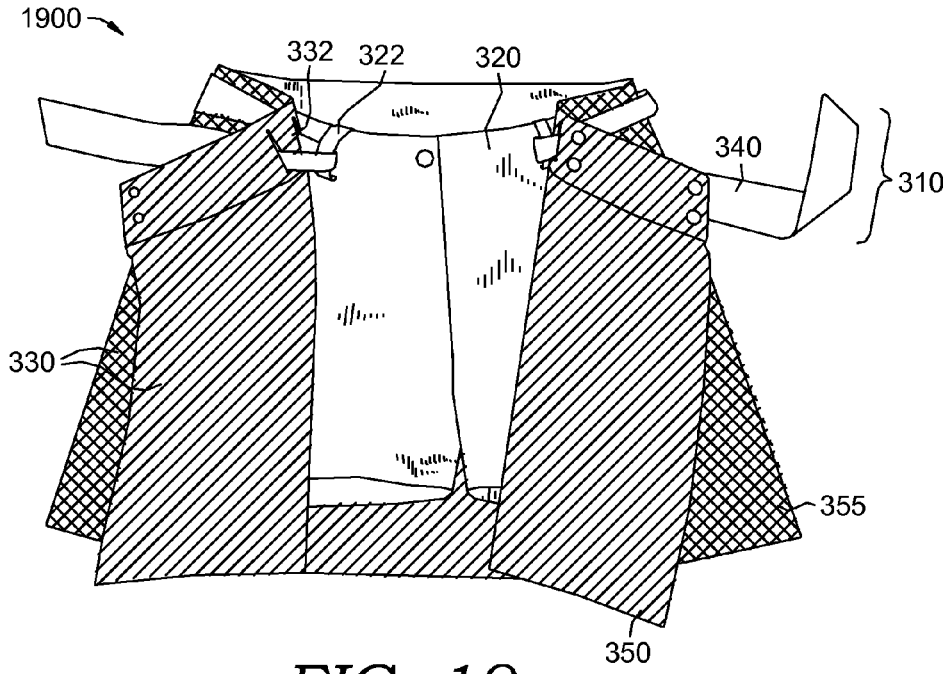
FIG. 19 illustrates a perspective view of an opened second side of the skirt component of the multi-layered athletic garment of FIG. 18 in an open position in accordance with the present invention.

FIG. 19 illustrates a perspective view 1900 of an opened second side of the skirt component of the multi-layered athletic garment of FIG. 18 in an open position in accordance with the present invention. In particular, FIG. 19 illustrates second side 355 of skirt component 330 covering shorts component 320 of multi-layered athletic garment 310. Further, skirt component 330 is opened to reveal first side 350 of skirt component 330. As with the embodiment shown in FIG. 18, skirt component 330 is secured to shorts component 320 by passing a belt 340 through shorts belt loops 322 and skirt belt loops 332.

Figure 20:
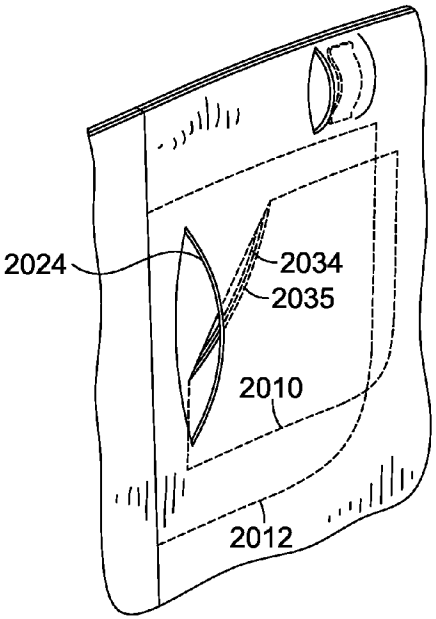
FIG. 20 illustrates a perspective view of a pocket.

FIG. 20 illustrates a skirt pocket that is a pass-through pocket into a shorts pocket.

Figure 22:
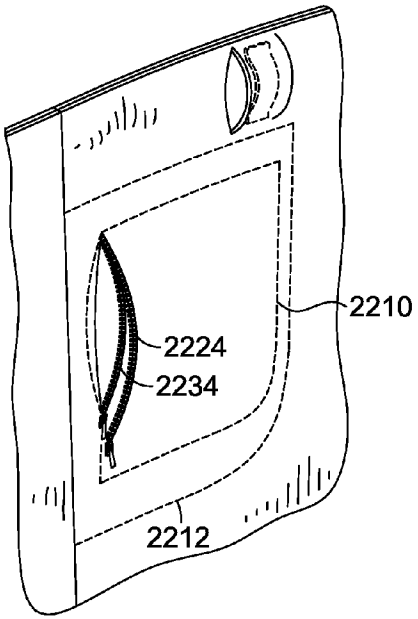
FIG. 22 illustrates a perspective view of a pocket.
Figure 21:
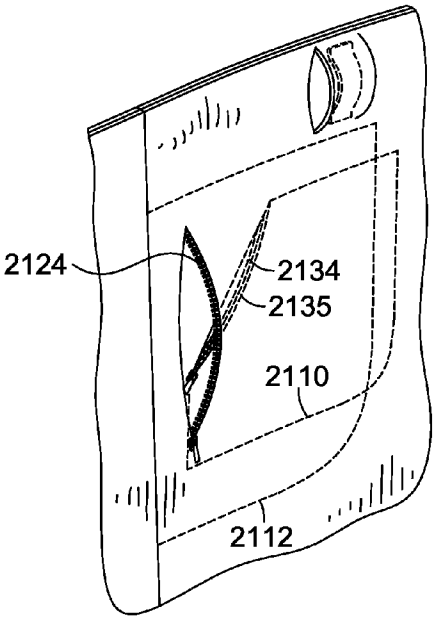
FIG. 21 illustrates a perspective view of a pocket.
Figure 25:
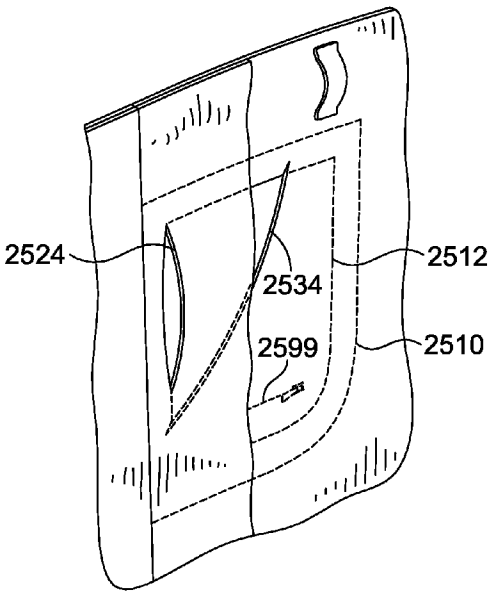
FIG. 25 illustrates a perspective view of a pocket.
Figure 24:
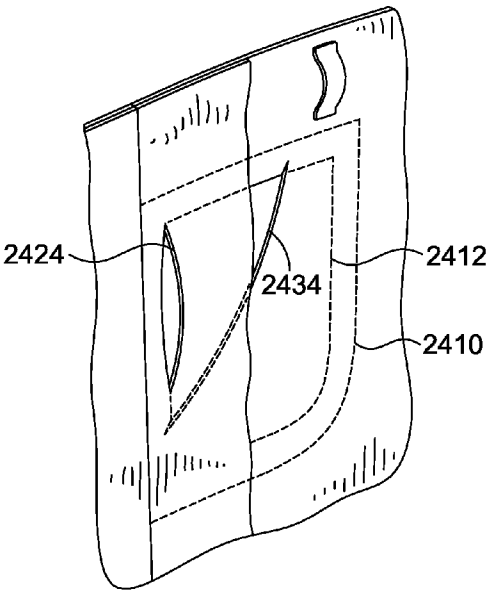
FIG. 24 illustrates a perspective view of a pocket.
Figure 23:
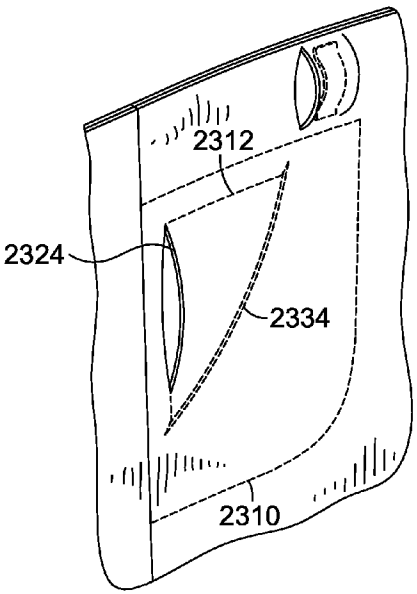
FIG. 23 illustrates a perspective view of a pocket.

FIG. 20 shows a skirt pocket 2012 with an opening 2024 from the inside of the skirt pocket 2012 to the outside of the skirt pocket 2012 and an opening 2034 from the inside of the skirt pocket 2012 to an opening 2035 of a shorts pocket 2010. FIG. 21 illustrates a skirt pocket comprising a zipper that is a pass-through pocket into a shorts pocket. FIG. 21 shows a skirt pocket 2012 with an opening 2124 from the inside of the skirt pocket 2012 to the outside of the skirt pocket 2012. The opening 2124 has a zipper. Skirt 2112 also has an opening 2134 from the inside of skirt pocket 2012 to tan opening 2135 of shorts pocket 2110. Skirt pocket opening 2134 has a zipper. FIG. 22 illustrates a skirt pocket that is a pass-through pocket and a shorts pocket, wherein the skirt pocket zips together with the shorts pocket. FIG. 22 shows skirt pocket 2210 with an opening 2224 from the outside of the skirt pocket 2212 to the inside of the skirt pocket 2210. Skirt pocket opening 2224 has a zipper. FIG. 22 also shows a shorts pocket 2212 with an opening 2234 from the outside of shorts pocket 2212 to the inside of shorts pocket 2212. Shorts pocket opening 2234 has a zipper. Skirt pocket 2210 is shown fitting inside shorts pocket 2212. FIG. 23 illustrates a skirt pocket that fits into a shorts pocket. FIG. 23 shows a skirt pocket 2312 with an opening 2324 from the outside of skirt pocket 2312 to the inside of skirt pocket 2312. FIG. 23 also shows shorts pocket 2310 with an opening 2334 from the outside of shorts pocket 2310 to the inside of shorts pocket 2334. Skirt pocket 2312 is shown fitting into shorts pocket 2310. FIG. 24 illustrates a cutaway of a skirt portion to better illustrate a skirt pocket fitting into a shorts pocket. FIG. 24 shows a skirt pocket 2412 with an opening 2424 from the outside of skirt pocket 2412 to the inside of skirt pocket 2412. FIG. 24 also shows shorts pocket 2410 with an opening 2434 from the outside of shorts pocket 2410 to the inside of shorts pocket 2434. FIG. 24 shows skirt pocket 2412 being smaller and fitting into shorts pocket 2410. FIG. 25 illustrates a cutaway of a skirt portion to better illustrate a skirt pocket that is a pass-through pocket comprising a zipper, wherein the skirt pocket fits into a shorts pocket. FIG. 25 shows a skirt pocket 2512 with an opening 2524 from the outside of skirt pocket 2512 to the inside of skirt pocket 2512. FIG. 25 also shows shorts pocket 2510 with an opening 2534 from the outside of shorts pocket 2510 to the inside of shorts pocket 2534. FIG. 25 shows skirt pocket 2512 being smaller and fitting into shorts pocket 2510. Further FIG. 25 shows skirt pocket 2512 having an opening 2599 from the inside of skirt pocket 2512 to the inside of shorts pocket 2510, where the opening has a zipper 2599.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. Such variations are not to be regarded as a departure from the invention, and all such modifications are intended to be included within the scope of the invention.

What is claimed is:

1. A garment comprising:

a skirt component comprising a plurality of skirt belt loops, a top skirt waistband edge, and an opposing skirt bottom edge, wherein at least a portion of the plurality of skirt belt loops are positioned between the top skirt waistband edge and the skirt bottom edge, wherein the top skirt waistband edge is positioned closer to the plurality of skirt belt loops than the skirt bottom edge, wherein the skirt component is at least partly defined by the top skirt waistband edge and the opposing skirt bottom edge, and wherein the top skirt waistband edge at least partly defines a skirt waist through-opening and the opposing skirt bottom edge at least partly defines a skirt leg through-opening; and a shorts component comprising a plurality of shorts belt loops each designed to be aligned with a skirt belt loop of the plurality of skirt belt loops, the plurality of the shorts belt loops being structured differently from the plurality of the skirt belt loops, wherein each skirt belt loop of the plurality of skirt belt loops defines a void through which each corresponding shorts belt loop of the plurality of shorts belt loops is designed to pass, wherein each shorts belt loop of the plurality of shorts belt loops and each corresponding skirt belt loop of the plurality of skirt belt loops are designed to cooperatively form an integrated belt loop for a belt to be passed therethrough such that at least a portion of the belt is to be positioned beneath at least a portion of the shorts belt loop and at least a portion of the skirt belt loop, the shorts component further comprising a top shorts waistband edge and an opposing shorts bottom edge, wherein at least a portion of the plurality of shorts belt loops are positioned between the top shorts waistband edge and the shorts bottom edge, wherein the top shorts waistband edge is positioned closer to the plurality of shorts belt loops than the shorts bottom edge, wherein the shorts component is at least partly defined by the top shorts waistband edge and the shorts bottom edge, wherein the top shorts waistband edge at least partly defines a shorts waist through-opening and the shorts bottom edge at least partly defines first and second shorts leg though-openings, and wherein the top skirt waistband edge and the top shorts waistband edge are substantially aligned when each shorts belt loop of the plurality of shorts belt loops and each corresponding skirt belt loop of the plurality of skirt belt loops cooperatively form the integrated belt loop, wherein the skirt component substantially encircles the shorts component when each shorts belt loop of the plurality of shorts belt loops and each corresponding skirt belt loop of the plurality of skirt belt loops cooperatively form the integrated belt loop, and wherein the skirt component is separable from the shorts component.

2. The garment of claim 1, wherein the skirt belt loops of the plurality of skirt belt loops are aligned asymmetrically with respect to a center line of the skirt component.

3. The garment of claim 1, wherein the skirt component is a wrap skirt.

4. The garment of claim 1, wherein the skirt component is a continuous skirt.

* * * * *